US005507682A

United States Patent [19]

Grahammer

[11] Patent Number: 5,507,682

[45] Date of Patent: Apr. 16, 1996

[54] SHOULDER STRAP FOR LADIES UNDERGARMENTS

[75] Inventor: Günter Grahammer, Lustenau, Austria

[73] Assignee: Triumph International Aktiengesellschaft, Munich, Germany

[21] Appl. No.: 402,912

[22] Filed: Mar. 10, 1995

Related U.S. Application Data

[63] Continuation-in-part of Ser. No. 165,107, Dec. 10, 1993, abandoned.

[30] Foreign Application Priority Data

Dec. 14, 1992 [AT] Austria ..... 42460/92

[51] Int. Cl.[6] ..... A41F 15/00; A41D 27/00

[52] U.S. Cl. ..... 450/86; 450/92; 2/338; 2/243.1; 139/421

[58] Field of Search ..... 2/144, 146, 300, 2/311, 312, 243.1, 268, 338; 450/86, 92; 139/384 R, 421

[56] References Cited

U.S. PATENT DOCUMENTS

| | | | |
|---|---|---|---|
| 694,108 | 2/1902 | Nierhaus & Kraiser | 139/384 R |
| 991,034 | 5/1911 | Smith | 139/384 R |
| 1,095,740 | 5/1914 | Seidman | 139/384 R |
| 2,661,776 | 12/1953 | Gamber et al. | 139/421 |
| 3,860,046 | 1/1975 | Goff, Jr. et al. | 139/421 |
| 4,100,924 | 7/1978 | Rosenberg | 450/86 |
| 4,795,400 | 1/1989 | Greenberg | 450/86 |
| 5,165,113 | 11/1992 | Hyams et al. . | |

FOREIGN PATENT DOCUMENTS

| | | |
|---|---|---|
| 0145615 | 6/1985 | European Pat. Off. . |
| 2486971 | 1/1982 | France . |
| 3609845 | 9/1987 | Germany . |

*Primary Examiner*—Jeanette E. Chapman
*Attorney, Agent, or Firm*—Friedrich Kueffner

[57] ABSTRACT

A shoulder strap for ladies' undergarments, more particularly a shoulder strap for brassieres, includes elastic warp threads and weft threads extending transversely of and woven into the warp threads. The shoulder strap has a longitudinal middle portion whose width is greater as compared to the width of the shoulder strap portions extending longitudinally from the middle portion. The spacing between the warp threads in the middle portion is greater than the spacing of the warp threads in the shoulder strap portions connected to the middle portion. The number of weft threads per unit of length in the longitudinal middle portion is greater than in the shoulder strap portions connected to the middle portion. The number of weft threads per unit of length in the middle portion may be approximately 50% greater than the number of weft threads per unit of length in the shoulder strap portions connected to the middle portion.

3 Claims, 1 Drawing Sheet

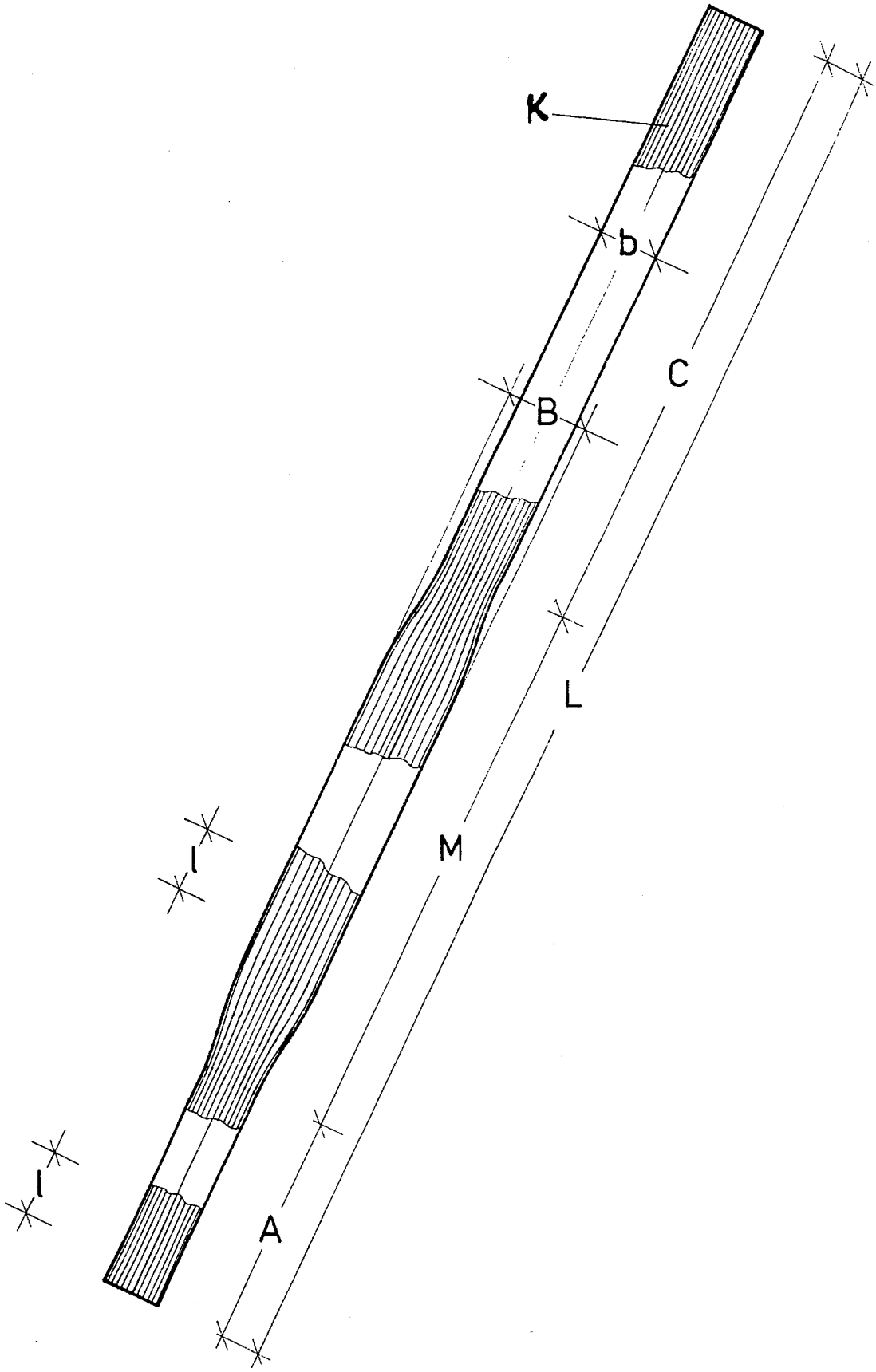
K
b
C
B
L
M
l
l
A

SHOULDER STRAP FOR LADIES UNDERGARMENTS

This is a continuation-in-part of prior application Ser. No. 08/165,107, now abandoned filed on Dec. 10, 1993.

BACKGROUND OF THE INVENTION

1. Field of the Invention

The present invention relates to a shoulder strap for ladies' undergarments and more particularly to a shoulder strap for brassieres. The shoulder strap has a longitudinal middle portion whose width is enlarged as compared to the width of the shoulder strap portions extending from both ends of the middle portion.

2. Description of the Related Art

Shoulder straps of the above-identified type are known. Because of their elasticity, the shoulder straps can follow the movements of the body or the body parts of the wearer, so that the article of clothing supported by the shoulder strap exerts no tensile or compressive stresses or only slight tensile or compressive stresses onto the body of the wearer of the article of clothing. A shoulder strap of this type is placed over the shoulder of the person wearing the article of clothing, wherein the longitudinal middle portion of the shoulder strap rests on the shoulder and the two shoulder strap portions connected to the middle portion extend downwardly along the chest and back, respectively, of the wearer and are connected at their ends to the article of clothing.

A strap of this type is known from U.S. Pat. No. 4,100,924. This known strap is used for bags, ladies' undergarments, backpacks and the like. In this strap, the longitudinal middle portion has a width which is enlarged as compared to the width of the strap portions extending from both ends of the middle portion. When used as intended as a shoulder strap for undergarments, the enlarged portion of the shoulder strap is placed on the shoulder of the wearer and serves to transfer the weight over a large area of those parts of the shoulder which are by nature provided for this purpose, in order to prevent straining of nerve centers, blood vessels or sensitive cell areas of the skin.

The known shoulder strap described above is of very complicated construction. It includes strips of fabric sewn together at the edges thereof and having an enlarged middle portion, wherein this middle portion is provided with two pockets and extending diagonally of the axes of the strap. The pockets are formed by tucks and serve to accommodate flat support elements in the manner of corset stays which have the shape of a parallelogram. These supporting elements may be of various materials, such as, fishbone, plastic material or rubber-like materials. In addition, pads of foam material are placed under the inserts. Shoulder straps of this type unquestionably provide a high wearing comfort, particularly for carrying relatively heavy loads, i.e., when the shoulder strap is intended for use as a shoulder strap for backpacks, golf bags, bags for photographic equipment and the like. However, for ladies' undergarments and more particularly for brassieres, such a shoulder strap is much too complicated and too expensive and, for this reason, cannot be used in practice.

SUMMARY OF THE INVENTION

Therefore, it is the primary object of the present invention to provide a shoulder strap for ladies' undergarments which is manufactured in accordance with conventional manufacturing methods using ribbon looms, wherein the shoulder strap provides increased wearing comfort.

In accordance with the present invention, a shoulder strap of the above-described type has the following features. The shoulder strap is manufactured in the known manner from elastic warp threads and weft hotheads which extend transversely of and are woven into the warp threads. In the longitudinal middle portion of the shoulder strap, the spacing between the warp threads is increased as compared to the spacing between warp threads in the shoulder strap portions connected to the middle portion. The number of weft threads per unit of length in the longitudinal middle portion is greater than in the shoulder strap portions connected to the middle portion.

As a result of the proposal according to the present invention, conventional technologies can be employed on existing ribbon looms for manufacturing shoulder straps for ladies' undergarments providing high wearing comfort, even though the straps are partially composed of elastic threads.

In order to insure that, in spite of the large width of the middle portion in which the number of warp threads is actually not greater than in the narrower strap portions connected to the middle portion, the middle portion is sufficiently stable and firm, it is additionally provided that the number of weft threads per unit of length in the longitudinal middle portion is greater by approximately 50% than the number of weft threads per unit of length in the shoulder strap portions extending from the middle portion.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there is illustrated and described a preferred embodiment of the invention.

BRIEF DESCRIPTION OF THE DRAWING

In the drawing:

The single figure of the drawing is a top view of a shoulder strap according to the present invention.

DETAILED DESCRIPTION OF THE PREFERRED EMBODIMENT

The drawing schematically shows a shoulder strap according to the present invention which is spread out on a plane level. The shoulder strap has a length L, with a longitudinal middle portion M and the two shoulder strap portions A and C extending from the middle portion M. As can be seen in the drawing, the width B of the longitudinal middle portion M of the shoulder strap is enlarged as compared to the width b of the shoulder strap portion A, C extending from the middle portion M.

The shoulder strap includes warp threads K, only schematically indicated in the drawing, which are elastically deformable. The elasticity of these warp threads K may result from the material of which they are made or from the specific type of the threads proper. Weft threads, not shown in the drawing, are inserted by weaving into the warp threads K which extend in longitudinal direction of the shoulder strap. As schematically shown in the drawing, the spacing between the warp threads X in the longitudinal middle portion of the shoulder strap is enlarged or increased as compared to the spacing between the warp threads in the shoulder strap portions A, C connected to the middle portion M. The number of weft threads per unit of length l in the longitudinal middle portion M is greater than in the shoulder strap portions A, C connected to the middle portion M; more particularly, the number of weft threads per unit of length l in the longitudinal middle portions M is 50% greater than in the shoulder strap portions A, C.

The ratio of the total length L of the shoulder strap to the length of the enlarged middle portion M is approximately 3.5. The ratio of the width B of the longitudinal middle section M to the width b of the adjacent shoulder strap portions A, C is approximately 1.2. The two shoulder strap portions A, C extending from the middle portion M have different lengths.

The features according to the present invention make it possible to provide a shoulder strap which has an increased width along the middle length portion which rests on the body of the wearer, i.e., on the shoulder, so that the contact surface area of the middle section is increased and the elasticity is reduced, while the elasticity of the shoulder strap portions connected to the middle portion is maintained. It has been found in actual use that, because of the fact that the warp threads of the shoulder strap according to the present invention are elastic threads, the increase of the number of weft threads per unit of length in longitudinal direction in the middle portion of the shoulder strap has the result that the elasticity of the middle portion is reduced. The elasticity of the strap portions connected to the middle portion remains the same.

The invention is not limited by the embodiment described above which is prepared as an example only but can be modified in various ways within the scope of protection defined by the appended patent claims.

I claim:

1. A shoulder strap for ladies' undergarments, the shoulder strap comprising a longitudinal middle portion and two shoulder strap portions longitudinally extending and connected to the middle portion, the middle portion having a width which is greater than a width of the shoulder strap portions connected to the middle portion, wherein a ratio of the width of the longitudinal middle portion to the width of the shoulder strap portions connected to the middle portion is approximately 1.2, the shoulder strap further comprising elastic warp threads and weft threads extending transversely of and woven into the warp threads, a spacing being defined between the warp threads, the spacing between the warp threads in the middle portion being greater than the spacing of the warp threads in the shoulder strap portions connected to the middle portion, wherein the number of weft threads per unit of length in the longitudinal middle portion is approximately 50% greater than the number of weft threads per unit of length in the shoulder strap portions connected to the middle portion, so that the longitudinal middle portion has a reduced elasticity as compared to the shoulder strap portions connected to the middle portion.

2. The shoulder strap according to claim 1, wherein the shoulder strap has a total length and the longitudinal middle portion has a length, wherein a ratio of the total length of the shoulder strap to the length of the middle portion is approximately 3.5.

3. The shoulder strap according to claim 1, wherein the two shoulder strap portions connected to the middle portion have different lengths.

* * * * *